US005678339A

United States Patent [19]

Marventano

[11] Patent Number: 5,678,339

[45] Date of Patent: Oct. 21, 1997

[54] INTEGRATED PICTURE FRAME AND STAND APPARATUS

[75] Inventor: James R. Marventano, Kenmore, N.Y.

[73] Assignee: Stone Container Corporation, Chicago, Ill.

[21] Appl. No.: 568,350

[22] Filed: Dec. 6, 1995

[51] Int. Cl.[6] ..... A47G 1/06

[52] U.S. Cl. ..... 40/789; 40/774

[58] Field of Search ..... 40/539, 774, 786, 40/788, 789

[56] References Cited

U.S. PATENT DOCUMENTS

| | | | |
|---|---|---|---|
| 752,283 | 2/1904 | Cohn | 40/788 |
| 823,307 | 6/1906 | Stovel | 40/774 |
| 944,385 | 12/1909 | Spiegel | 40/445 |
| 952,292 | 3/1910 | Wright | 40/786 X |
| 1,518,207 | 12/1924 | McCauley | 40/788 X |
| 1,524,338 | 1/1925 | Chesney | 40/789 |
| 1,711,199 | 4/1929 | Hatch | 40/786 X |
| 2,519,183 | 8/1950 | Greenspon | 40/754 |
| 2,568,899 | 9/1951 | Rambow | 40/786 |
| 2,581,733 | 1/1952 | Trask | 40/786 |
| 2,600,429 | 6/1952 | Ranseen | 40/786 X |
| 2,634,531 | 4/1953 | Fielding | 40/788 |
| 2,638,693 | 5/1953 | Foster | 40/789 |
| 2,660,825 | 12/1953 | Howard | 40/789 |
| 2,731,748 | 1/1956 | Polay | 40/787 |
| 2,737,742 | 3/1956 | Leigh | 40/605 |
| 2,762,148 | 9/1956 | Alcaraz | 40/788 |
| 2,773,324 | 12/1956 | Drueck, Jr. | 40/787 |
| 2,795,071 | 6/1957 | Gorham | 40/786 |
| 2,814,896 | 12/1957 | Fujikawa | 40/788 |
| 2,881,662 | 4/1959 | Harris | 40/539 X |
| 2,889,646 | 6/1959 | Matthias et al. | 40/788 X |
| 3,473,777 | 10/1969 | Ketterer | 40/789 X |
| 3,757,445 | 9/1973 | Stilwell | 40/154 |
| 4,244,128 | 1/1981 | Russell | 40/154 |
| 4,309,835 | 1/1982 | Naeve | 40/310 |
| 4,479,318 | 10/1984 | Russell | 40/154 |
| 4,622,769 | 11/1986 | Friedman | 40/152.1 |
| 4,738,041 | 4/1988 | Drueck, Jr. | 40/155 |
| 4,819,354 | 4/1989 | Papov | 40/789 |
| 4,934,078 | 6/1990 | Sloot | 40/152.1 |
| 5,343,643 | 9/1994 | Cochrane | 40/155 |
| 5,359,794 | 11/1994 | Wood | 40/155 |
| 5,361,521 | 11/1994 | Burtch | 40/152.1 |
| 5,365,684 | 11/1994 | Cartmell | 40/155 |
| 5,439,101 | 8/1995 | Brink et al. | 40/789 X |

FOREIGN PATENT DOCUMENTS

| | | | |
|---|---|---|---|
| 2534127 | 4/1984 | France | 40/152 |
| 695319 | 9/1965 | Italy | 40/539 |
| 315143 | 7/1929 | United Kingdom | 40/539 |
| WO 80/02884 | 12/1980 | WIPO | 40/539 |

*Primary Examiner*—Kenneth J. Dorner
*Assistant Examiner*—Andrea Chop
*Attorney, Agent, or Firm*—Dick and Harris

[57] ABSTRACT

An integrated picture frame and stand apparatus articulable from a blank of foldable material, and upon articulation, positionable and free standing on a support surface. The apparatus includes a face member, at least one back member, and a frame stand member that co-operate to maintain the picture in place within the frame while maintaining the frame in an upright position. The frame stand member may further include a locking wing member hingedly attached to the frame stand member and a base member, which upon articulation, and through the use of tabs and slots, restrain the positions of all cooperating elements to further maintain the device in its articulated orientation.

20 Claims, 2 Drawing Sheets

Fig 5
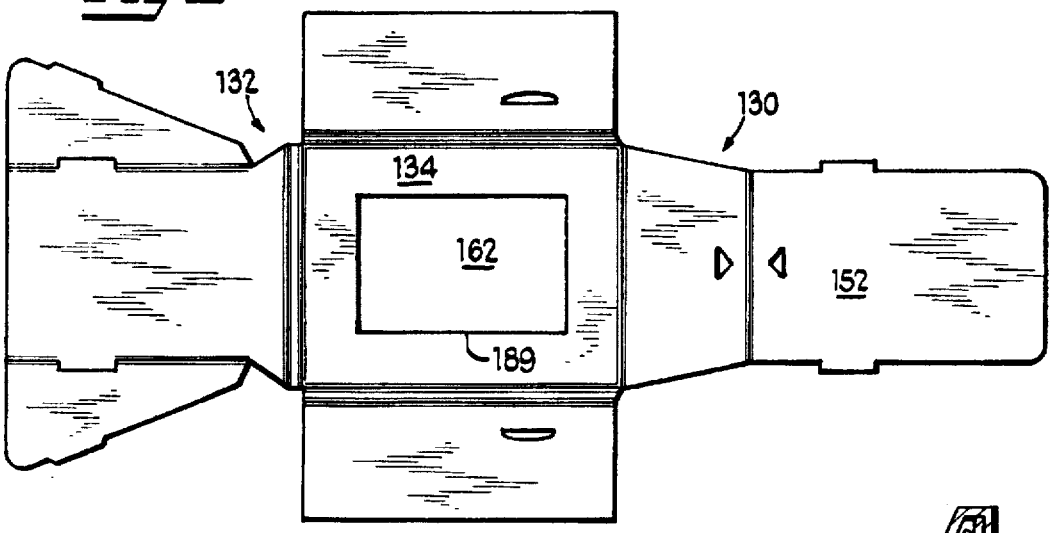
Fig 6
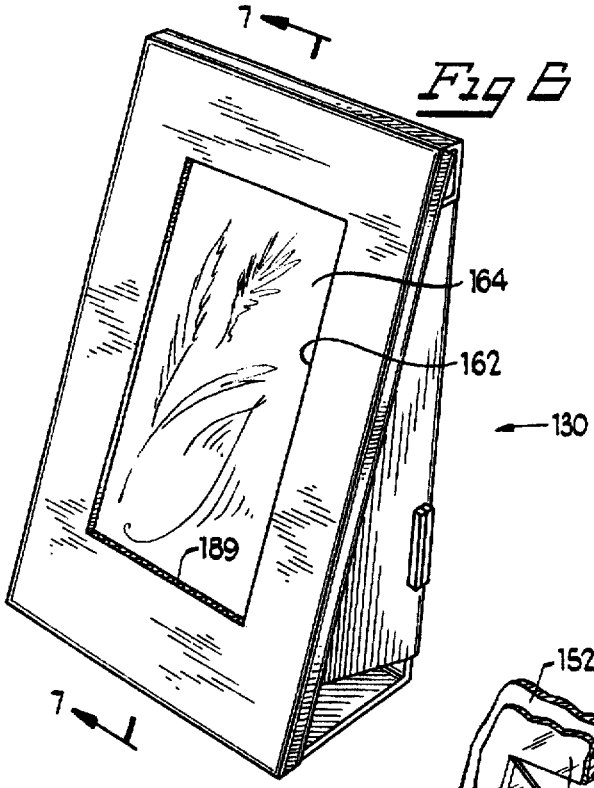
Fig 7
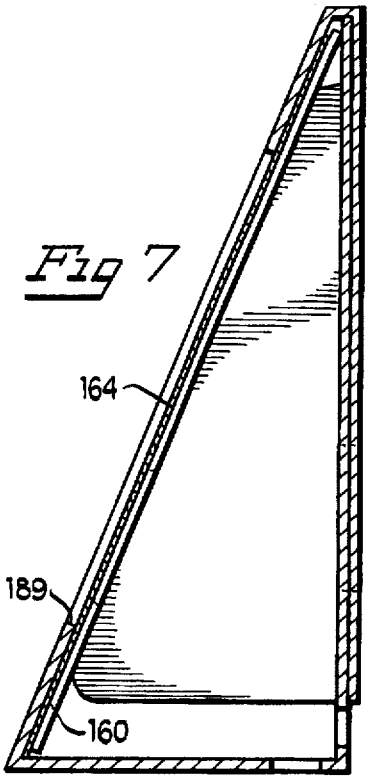
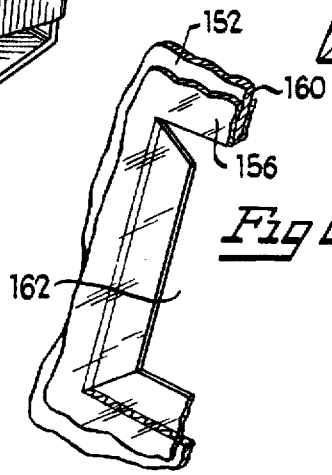
Fig 8

INTEGRATED PICTURE FRAME AND STAND APPARATUS

BACKGROUND OF THE INVENTION

The present invention relates in general to a picture frame apparatus for displaying articles such as pictures, and, more particularly, to an integrated picture frame and stand apparatus articulable from a blank of flat paper material capable of freely standing on an external surface.

The use of a picture frame to display pictures, documents, diplomas and other items is quite common. It is desirable not only to mount pictures on walls but also to keep pictures in frames freely standing on external surfaces, such as a desk, cabinet or dresser.

One solution has been the use of a separate picture frame stand structure position the frame on the stand. This solution has several drawbacks. Often times, the stand in not stable enough to support the frame, and combined, the unit is quite cumbersome. A further drawback is that the stand for supporting a picture frame is often times made from wood, metal or plastic which can be quite expensive, thus adding to the overall cost.

A less expensive alternative has been to integrate a frame and a stand. One such frame uses a single sheet of clear plastic which is molded to have a base, an angled face through which the picture is viewed and a folded-over back which applies pressure on the face and retains the picture in its place. This solution is quite cumbersome inasmuch as the frame and stand are integral, rigid and not collapsible. Further, the plastic may not be suitable for more decorative applications.

There have also been picture frames with an integrated stand made from a single blank of corrugated paper material. These solutions, while inexpensive, are often not attractive. The simple construction from corrugated paperboard may not appear to be finished at the edges, thereby exposing the corrugation flutes. Further, these frames are prone to warping and bending. When warped, it is difficult to return the frame to the proper shape without marring the frames surface. Additionally, many of the "integrated" stands are weak and unstable, preventing the user from fully utilizing the stand, or worse yet, precluding straight and restrained finalized articulation.

For instance, Freidman U.S. Pat. No. 4,622,769 (the '769 reference) is a construction, in which not only is the stand apparatus not attractively finished, but also the viewing area of the frame portion displays the picture in a bent orientation. As such, not only is the picture difficult to properly view, it may adversely affect or damage the picture itself. Further, the frame may not be suitable for decorative purposes, due to the construction.

Accordingly, it is an object of the present invention to provide for an inexpensive picture frame that is securely integrated with a locked stand portion for sturdy display of the picture—in an environment in which various flat components not only secure the viewable article in place but also securely prompt and maintain the frame itself into and in its articulated, upright orientation.

Further, it is an object of the present invention to be articulated from one blank of such material, such as corrugated paper material, with structural integrity, and a highly decorative and attractive finish.

These and other objects of the present invention will become apparent in light of the present specification, claims and drawing.

SUMMARY OF THE INVENTION

The present invention comprises an integrated picture frame and stand apparatus. The apparatus is articulable from a blank of foldable material and, upon articulation, positionable and free standing on a supporting surface. The apparatus comprises a face member, at least one back member, a frame stand member and frame stand member spacing means. The face member includes a front surface, a back surface, an exterior perimeter, and an interior opening. The interior opening is defined by an interior perimeter which defines a viewing region for display of the picture. The at least one back member is hingedly attached to the exterior perimeter of the face member, and, upon articulation, is rotatably positioned to approach abutment of the back surface of the face panel. As such, the picture is maintained in interposed abutment between the back surface of the face panel and the at least one back panel.

The frame stand member is likewise hingedly attached to the exterior perimeter of the face member. Upon articulation, the frame stand member is rotatably positioned behind the at least one back member and is positioned in a vertical orientation. Frame stand member spacing means serve to distance and maintain the frame stand member in an angled orientation relative to the face member.

In a preferred embodiment the frame stand spacing means comprises at least one locking wing member, which extends between an edge of the frame stand member, and, upon articulation, between said frame stand member and said at least one back member to distance and maintain said frame stand member apart from said back member. Thus, the apparatus is maintained upright towards the free standing display of an article.

In a preferred embodiment, the apparatus may further include a base member and a base stand member. The base member is hingedly attached to the exterior perimeter of the face member and, upon articulation, is positionable between one of the face and back members to a restrained position along the frame stand member. The base stand member is hingedly attached to the base member and fixedly restrained to the frame stand member. The base stand member, in a preferred embodiment, is positioned in a substantially vertical orientation and juxtaposed to the frame stand member.

Likewise, in a preferred embodiment, the apparatus further includes first attachment means and second attachment means. First attachment means include at least one mating tab on the wing member capable of interlocking with at least one receiving aperture on the at least one back member. Further, second attachment means include at least one protrusion tab on the base stand member capable of interlocking engagement with at least one receiving opening on the frame stand member. The first and second attachment means permit interlocking engagement to enhance the structural integrity of the apparatus, and likewise serve to eliminate the need for glues and adhesives to be used during articulation.

In a preferred embodiment, the apparatus further includes foldable flaps disposed on each side of the interior perimeter. These provide a continuous edge to the interior perimeter thereby enhancing the overall appearance of the apparatus.

It is contemplated that the apparatus be constructed from a single blank of corrugated paperboard material. In a preferred embodiment, the single blank of corrugated paperboard material is covered with a laminate. Such a laminate covers the corrugated paperboard so that the apparatus appears quite attractive. In a preferred embodiment, wherein the foldable flaps are eliminated, the laminate may be cut such that it extends beyond the interior perimeter of the face member. This overlaying laminate may be folded over the interior perimeter to cover the edges of corrugated material created by the interior perimeter.

BRIEF DESCRIPTION OF THE DRAWINGS

FIG. 5 of the drawings is a top plan view of the unerected blank of an alternative embodiment of an integrated picture frame and stand apparatus;

FIG. 6 of the drawings is a perspective view of the embodiment of the apparatus of FIG. 5, showing, in particular, the erected apparatus containing a picture in the opening;

FIG. 7 of the drawings is a fragmentary view of the embodiment of the integrated picture frame and stand apparatus of FIG. 6, taken generally along lines 7—7 of FIG. 6; and FIG. 8 of the drawings is a fragmentary view of the front member of the integrated picture frame and stand apparatus of FIG. 5.

DETAILED DESCRIPTION OF THE DRAWINGS

Figure 1:
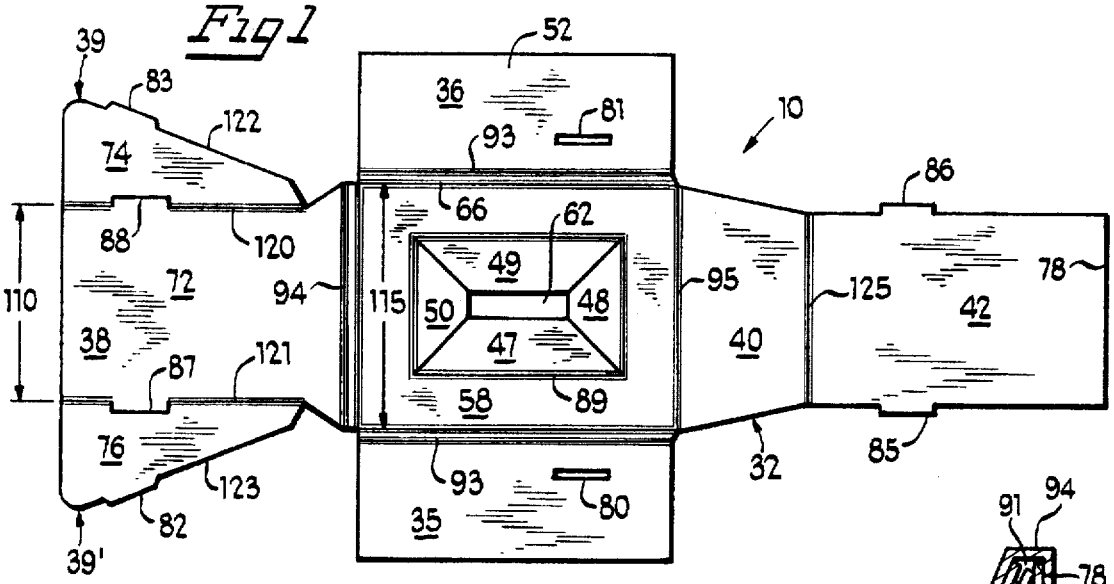
FIG. 1 of the drawings is a top plan view of the unerected blank of an integrated picture frame and stand apparatus embodying the present invention.

While this invention is susceptible of embodiment in many different forms, there is shown in the drawings and will herein be described in detail, several specific embodiments with the understanding that the present disclosure can be considered as an exemplification of the principles of the invention and is not intended to limit the invention to the embodiments illustrated.

An integrated picture frame and stand apparatus 10 is shown in FIG. 1 as including an articulable blank form 32 which comprises face member 34, first back member 35, second back member 36, frame stand member 38, frame stand member spacing means 39, 39', base member 40 and base stand member 42. Face member 34, includes front surface 58, back surface 60 (FIG. 3), interior opening 62 and exterior perimeter 66 defined by side edge 92 and 93, top edge 94 and bottom edge 95. Interior opening 62 is defined by interior perimeter 89, and upon articulation of integrated picture frame and stand apparatus 10, provides a viewing region for an article 64 (FIG. 2) such as a photograph or the like. While other configurations and shapes are contemplated, in a preferred embodiment, both face member 34 and interior opening 62 are concentric and generally rectangular in surface configuration. As such, at any given point, the distance between interior perimeter 89 and exterior perimeter 66 is substantially the same—thereby resulting in a uniform boarder encircling article 64.

First back member 35 and second back member 36 are hingedly attached to side edges 92 and 93, respectively, of exterior perimeter 66 of face member 34. As can be seen in FIG. 3, picture (article) 64 has a portion of its front side 96 positioned adjacent back surface 60 of face member 34. In turn, the picture's rear side 97 will be in abutment with back members 35 and 36 (FIG. 4)—after articulation (as will be explained). Also shown in FIG. 2 is a transparent protection sheet 100, which can be readily applied over front side 96 of picture 64.

Frame stand member 38 is shown in FIG. 3 as comprising back plate member 72, which is hingedly attached to top edge 94 of exterior perimeter 66 of face member 34. Upon articulation, back plate member 72 is rotatably positioned such that the back plate member and front panel member 34 create acute fold 91 (FIG. 3). As can be seen in FIG. 1, the transverse dimension 110 of back plate member 72 is slightly narrower than the transverse dimension 115 of face member 34—although other relative dimensions are also contemplated. However, when utilizing the present dimension, the narrower construction of the back plate member will result in an integrated picture frame and stand apparatus 10 visually devoid of it back plate member 72, upon articulation, and when the apparatus is observed, straight on.

Figure 2:
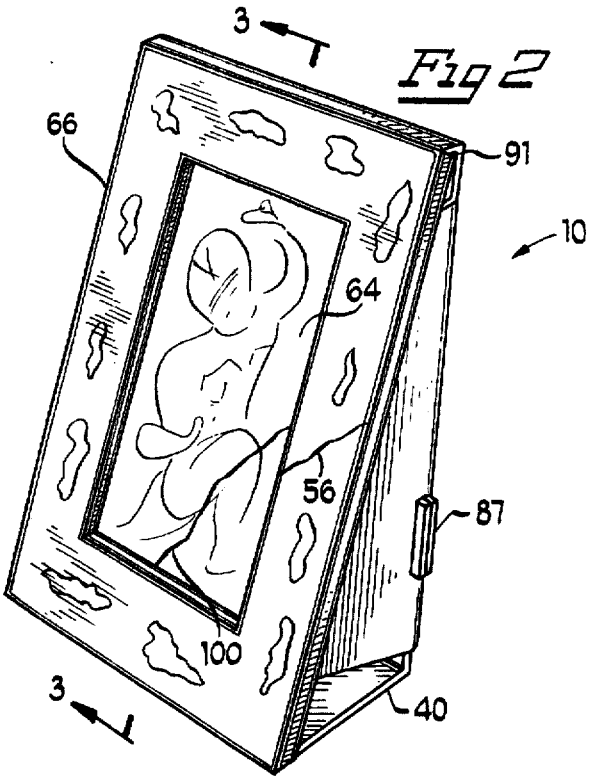
FIG. 2 of the drawings is a perspective view of the apparatus, showing in particular the erected apparatus containing a picture in the opening.
Figure 3:
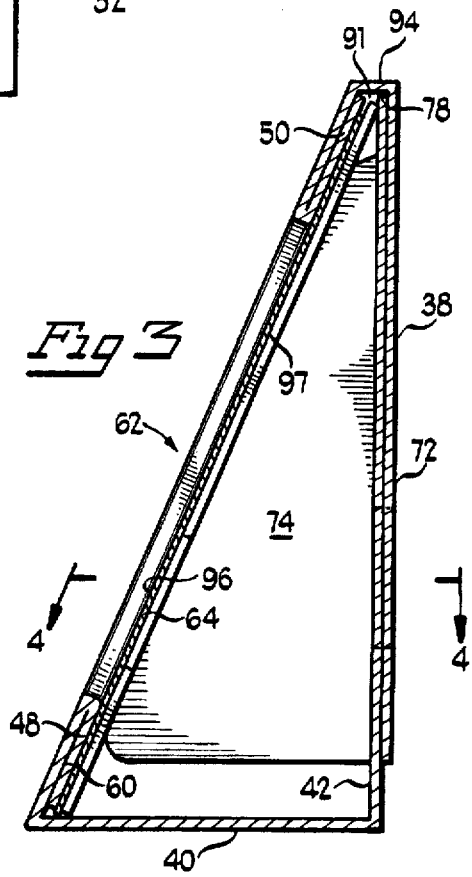
FIG. 3 of the drawings is a fragmentary view of the integrated picture frame and stand apparatus of FIG. 2, taken generally along lines 3—3 of FIG. 2.
Figure 4:
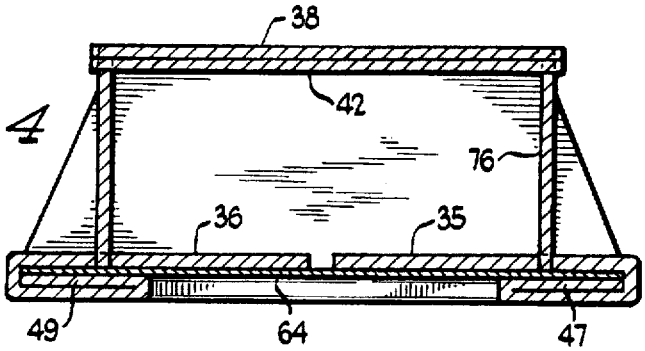
FIG. 4 of the drawings is a fragmentary view of the integrated picture frame and stand apparatus of FIG. 2, taken generally along lines 4—4 of FIG. 3.

As seen in FIG. 2 and FIG. 3, frame stand member spacing means 39, 39' comprises first locking wing member 74 and second locking wing member 76, both hingedly attached to back plate 72 along hinge lines 120 and 121, respectively. Upon articulation, both first locking wing member 74 and second locking wing member 76 are rotated in a manner so that their respective outer edges 122 and 123 abut first back member 35 and second back member 36, respectively. Additionally, in such an articulated position, first locking wing member 74 and second locking wing member 76 apply pressure on first back member 35 and second back member 36, respectively, to, in turn, result in the first and second back members being in closer abutment with back surface 60 of face member 34 then otherwise would result. Such pressure further maintains article 64 in the proper predetermined orientation, and, in turn, further prevents inadvertent repositioning of picture 64 due to external forces or accidental movement.

Locking wing members 74, 76 of frame stand member spacing means 39, 39' additionally maintain back plate member 72 in a desired angled orientation relative to face member 34 and first and second back members 35, 36. This orientation maintains integrated picture frame and stand apparatus 10 upright towards the free standing display of article 64.

Base member 40, as shown in FIG. 3, is hingedly attached to top edge 95 (FIG. 1) of exterior perimeter 66 of face member 34. Base stand member 42 (FIG. 4) is hingedly attached to base member 40 along hinge line 125 (FIG. 1). Base stand member 42 includes far end 78 opposite the end which is attached to base member 40. Upon articulation, base member 40 is generally positioned in a substantially horizontal configuration. Base stand member is rotatably positioned in a substantially vertical orientation parallel to and juxtaposed with back plate member 72. Far end 78 of base stand member 42 abuts acute fold 91 (FIG. 3), at the hinged attachment of face member 34 and frame stand member 38, and is cradled in acute fold 91 to, in turn, further fix the orientation of base member 40, frame stand member 38 and face member 34. Thus, by varying the length of the base stand member 42, i.e. the distance between the base member 40 and far end 78 of base stand member 42, the angle between base member 40 and face member 34 may be varied to position the face member 34 at a differing angle relative base member 40.

It is contemplated that, upon articulation, base member 34 will be in abutment with the external supporting surface for viewing purposes. However, it is also contemplated that apparatus 10 may be rotated horizontally on its side as well.

As shown in FIG. 1 integrated picture frame and stand apparatus 10 further includes first attachment means, which in a preferred embodiment, comprises first mating tab 82 operably attached to outer edge 123 of second locking wing 76, second mating tab 83 operably attached to outer edge 122 of first locking wing 74, first receiving aperture 80 operably positioned in first back member 35 and second receiving aperture 81 operably positioned in second back member 36. Upon articulation of frame stand member 38 and first back member 35, first mating tab 82 is positioned into lockable engagement with first receiving aperture 80. Likewise, second mating tab 83 is positioned into lockable engagement with second receiving aperture 81 on second back member 36. Once fully articulated, such attachment means prevent inadvertent movement of first and second locking wing members 74 and 76, respectively, while further facilitating a clamping action of back members 35 and 36 to article 64. Additionally, the attachment means also facilitate additional integrity of the fully articulated integrated picture frame and stand apparatus 10, such that no glue or other adhesives are required during articulation.

Second attachment means are shown in FIG. 1 as comprising and first protrusion tab 85 second protrusion tab 86 (both attached to base member 42), first receiving opening 87 and second receiving opening 88 (both formed in first and second locking members 74 and 76, respectively). Upon articulation, and as far end 78 of base stand member 42 is positioned within acute fold 91 (FIG. 1 and FIG. 3), first protrusion tab 85 is positioned into first receiving opening 87. Likewise, second protrusion tab 86 is positioned into second receiving opening 88, to, in turn lock base stand member 42 relative to frame stand member 38—thereby precluding inadvertent movement therebetween. Like the first attachment means, second attachment means also eliminates the need for glue or adhesive during and after articulation.

As seen in FIG. 1 integrated picture frame and apparatus 10 further includes inner foldable flaps, such as inner foldable flaps 47, 48, 49, 50, disposed on each side of interior perimeter 89 of face member 34. Each of the foldable flaps are foldable along interior perimeter 89 and operably affixable to back surface 60 of face member 34 (FIG. 3). Once folded, the flaps will cover any exposed edges (i.e. fluted edges of corrugated material) of interior perimeter 89—so as to evoke a continuous edge to the interior perimeter, and, in turn, a decorative finish to interior perimeter 89 of face member 34.

While other configurations are contemplated, blank form 32 may comprise a single integrated blank of corrugated paperboard. Of course, other paperboard material, as well as other flexible materials, such as various conventionally used polymers are also contemplated for use.

As shown in FIG. 2, decorative laminate 56, which can be operably applied to the outside surface such as front surface 58 of face member 34 of blank form 32. Upon complete articulation, of integrated picture frame and stand apparatus 10, the decorative laminate will not only provide a visibly appealing appearance, but it will also permit the use of inexpensive corrugated or other paperboard material.

An alternative preferred embodiment of the present invention is shown in FIGS. 5–8. In this alternate embodiment, inner foldable flaps 47, 48, 49, 50 of previously described integrated picture frame and stand apparatus 10 of (FIGS. 1–4) are eliminated. Accordingly, integrated picture frame and stand apparatus 130, and more particularly blank form 132, has an interior perimeter 189 which defines a void 162. Furthermore, without the additional bulkiness of the foldable flaps of integrated picture frame and stad apparatus 30 (FIG. 1), the overall thickness of weight of integrated picture frame and stand apparatus 130 is substantially reduced. Thus, elimination of such inner foldable flaps will contribute to, among other things, the compactness of the apparatus. Further, the absence of such foldable flaps causes picture 164 to be forced directly against back surface 160 of face member 134. As a result, when a user is viewing the picture at a distance, picture 164 and face member 134 will appear contiguous.

As seen in FIG. 8, decorative laminate 156 is operably applied to outside surface 152 of blank 132 and extends into void 162, beyond interior perimeter 189. Prior to articulation, decorative laminate 156 is folded over interior perimeter 189, and adhered to back surface 158 of face member 134. Accordingly, a smooth edge is created that extends around the entirety of interior perimeter 189. Inasmuch as the laminate is quite thin, the distance that article 164 is separated from back surface 160 of face member 134 is minimal. Thus, article 164 and face member 134 essentially maintain a contiguous appearance while still eliminating unattractive paperboard construction from view.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An integrated article frame and stand apparatus articulable from a blank of foldable material, said apparatus, upon articulation, being positionable and free standing on a supporting surface, said apparatus comprising:

a face member including a front surface and a back surface opposite said front surface, said face member also including an interior opening therethrough defined by an interior perimeter, said interior perimeter defining a viewing region for display of an article;

said face member further including an exterior perimeter;

at least one back member hingedly attached to the exterior perimeter of said face member, upon articulation, said at least one back member rotatably positioned to approach abutment of said back surface of said face member so as to maintain said article in interposed abutment between the back surface of said face member and said at least one back member;

a frame stand member hingedly attached to the exterior perimeter of said face member which, upon articulation, is rotatably positioned behind said at least one back member, in a substantially vertical orientation, frame stand member spacing means for distancing and maintaining said entire frame stand member in an angled orientation relative to said face member and said at least one back member, at a position along the bottom of said apparatus, to, in turn, maintain said apparatus upright towards the free standing display of said article.

2. The apparatus according to claim 1 further including:

a base member restrainably oriented to extend from at least one of said face member and said at least one back member to a restrained position proximate to said frame stand member.

3. The apparatus according to claim 2 wherein said base member further includes:

a base stand member hingedly extending from said base member and fixedly restrained juxtaposed to said frame stand member.

4. The apparatus according to claim 3 wherein said base member, upon articulation of said apparatus, is positioned in a substantially horizontal configuration.

5. The apparatus according to claim 4 wherein said base stand member of said base member is, upon articulation, positioned in a substantially vertical orientation, said base stand member being juxtaposed to said frame stand member also positionable in said substantially vertical orientation.

6. The invention according to claim 1 in which the apparatus further includes inner foldable flaps disposed on each side of the interior perimeter of said face member to impart a continuous smooth edge to the interior perimeter.

7. The invention according to claim 1 in which the apparatus is constructed of a single integrated blank of material having an outside surface and an inside surface opposite said outside surface.

8. The invention according to claim 7 which said single integrated blank of material comprises a paper material.

9. The invention according to claim 8 in which said paper material comprises corrugated paperboard.

10. The invention according to claim 7 in which the apparatus further includes a decorative laminate covering at least a portion of said outside surface of material.

11. The invention according to claim 10 wherein at least a portion of said decorative laminate extends proximate said interior perimeter of said face member and over said viewing region in folding over said interior perimeter.

12. The invention according to claim 1 in which the apparatus further includes a transparent sheet of material adjacent the back surface of said face member to cover the viewing region of said face member, and, in turn, the displayed article.

13. An integrated article frame and stand apparatus articulable from a blank of foldable material, said apparatus, upon articulation, being positionable and free standing on a supporting surface, said apparatus comprising:

a face member including a front surface and a back surface opposite said front surface, said face member also including an interior opening therethrough defined by an interior perimeter, said interior perimeter defining a viewing region for display of an article;

said face member further including an exterior perimeter;

at least one back member hingedly attached to the exterior perimeter of said face member, upon articulation, said at least one back member rotatably positioned to approach abutment of said back surface of said face member so as to maintain said article in interposed abutment between the back surface of said face member and said at least one back member;

a frame stand member hingedly attached to the exterior perimeter of said face member which, upon articulation, is rotatably positioned behind said at least one back member, in a substantially vertical orientation;

frame stand member spacing means for distancing and maintaining said frame stand member in an angled orientation relative to said face member and said at least one back member, at a position along the bottom of said apparatus, to, in turn, maintain said apparatus upright towards the free standing display of said article;

a base member restrainably oriented to extend from at least one of said face member and said at least one back member to a restrained position proximate to said frame stand member;

a base stand member hingedly extending from said base member and fixedly restrained juxtaposed to said frame stand member;

said base member, upon articulation of said apparatus, is positioned in a substantially horizontal configuration;

said base stand member of said base member is, upon articulation, positioned in a substantially vertical orientation, said base stand member being juxtaposed to said frame stand member also positionable in said substantially vertical orientation; and said base stand member including a far end which is shaped and dimensioned to abut an acute fold defined by the hinged attachment of said face member and said frame stand member, upon articulation, said abutment of said base stand member within said acute fold serving to further align and restrain the orientation of said base member, frame stand member and said face member relative to one another.

14. An integrated article frame and stand apparatus articulable from a blank of foldable material, said apparatus, upon articulation, being positionable and free standing on a supporting surface, said apparatus comprising:

a face member including a front surface and a back surface opposite said front surface, said face member also including an interior opening therethrough defined by an interior perimeter, said interior perimeter defining a viewing region for display of an article;

said face member further including an exterior perimeter;

at least one back member hingedly attached to the exterior perimeter of said face member, upon articulation, said at least one back member rotatably positioned to approach abutment of said back surface of said face member so as to maintain said article in interposed abutment between the back surface of said face member and said at least one back member;

a frame stand member hingedly attached to the exterior perimeter of said face member which, upon articulation, is rotatably positioned behind said at least one back member, in a substantially vertical orientation, frame stand member spacing means for distancing and maintaining said frame stand member in an angled orientation relative to said face member and said at least one back member, at a position along the bottom of said apparatus, to, in turn, maintain said apparatus upright towards the free standing display of said article; and said spacing means of said frame stand member further including at least one locking wing member hingedly attached to said frame stand member which, upon articulation, fixedly extends between said frame stand member and said at least one back member to distance and maintain said frame stand member apart from said at least one back member.

15. The invention according to claim 14 in which the apparatus further includes first attachment means for restrainably attaching said frame stand member to said at least one back member.

16. The apparatus according to claim 15 wherein said first attachment means:

includes at least one mating tab on said at least one locking wing member, and at least one receiving aperture on said at least one back member for lockable alignment with and engagement between said at least one locking wing member and said at least one back member respectively.

17. An integrated article frame and stand apparatus articulable from a blank of foldable material, said apparatus, upon articulation, being positionable and free standing on a supporting surface, said apparatus comprising:

a face member including a front surface and a back surface opposite said front surface, said face member also including an interior opening therethrough defined by an interior perimeter, said interior perimeter defining a viewing region for display of an article;

said face member further including an exterior perimeter;

at least one back member hingedly attached to the exterior perimeter of said face member, upon articulation, said at least one back member rotatably positioned to approach abutment of said back surface of said face member so as to maintain said article in interposed abutment between the back surface of said face member and said at least one back member;

a frame stand member hingedly attached to the exterior perimeter of said face member which, upon articulation, is rotatably positioned behind said at least one back member, in a substantially vertical orientation, frame stand member spacing means for distancing and maintaining said frame stand member in an angled orientation relative to said face member and said at least one back member, at a position along the bottom of said apparatus, to, in turn, maintain said apparatus upright towards the free standing display of said article;

a base member restrainably oriented to extend from at least one of said face member and said at least one back member to a restrained position proximate to said frame stand member;

a base stand member hingedly extending from said base member and fixedly restrained juxtaposed to said frame stand member; and second attachment means for restrainably attaching said base stand member to said frame stand member.

18. The apparatus according to claim 17 wherein said second attachment means comprises:

at least one protrusion tab on said base stand member, and at least one receiving opening on said frame stand member, for lockable alignment and engagement with said at least one protrusion tab.

19. An integrated article frame and stand apparatus articulable from a blank of foldable material, said apparatus, upon articulation, being positionable and free standing on a supporting surface, said apparatus comprising:

a face member including a front surface and a back surface opposite said front surface, said face member also including an interior opening therethrough defined by an interior perimeter, said interior perimeter defining a viewing region for display of an article;

said face member further including an exterior perimeter;

at least one back member hingedly attached to the exterior perimeter of said face member, upon articulation, said at least one back member rotatably positioned to approach abutment of said back surface of said face member so as to maintain said article in interposed abutment between the back surface of said face member and said at least one back member;

a frame stand member hingedly attached to the exterior perimeter of said face member which, upon articulation, is rotatably positioned behind said at least one back member, in a substantially vertical orientation;

frame stand member spacing means for distancing and maintaining said frame stand member in an angled orientation relative to said face member and said at least one back member, at a position along the bottom of said apparatus, to, in turn, maintain said apparatus upright towards the free standing display of said article;

a base member restrainably oriented to extend from at least one of said face member and said at least one back member to a restrained position proximate to said frame stand member;

a base stand member hingedly extending from said base member and fixedly restrained juxtaposed to said frame stand member;

said face member being of substantially rectangular configuration having top, bottom and two side edges at its exterior perimeter;

said interior perimeter of said face member defining a generally rectangular configuration;

said frame stand member being hinged to the top edge of said exterior perimeter of said face member;

said base member being hinged to the bottom edge of said exterior perimeter of said face member;

said base member being hinged to said base stand member;

said at least one back member comprising two back members, each of said two back members of a generally rectangular configuration and having one receiving attachment aperture;

the apparatus including two locking wing members one each hingedly emanating from one side of said frame stand member, each of said two wing members including one mating tab for releasable engagement with said receiving aperture in each of said two back members, to prevent inadvertent disengagement therebetween said frame stand member and said back members; and second attachment means for restrainably attaching said base stand member to said frame stand member.

20. The apparatus according to claim 19 wherein the second attachment means comprises:

two protrusion tabs positioned on said base stand member, and two receiving openings positioned on at least one of said frame stand member and said two locking wing members, said two receiving openings configured for interlocking engagement with said two protrusion tabs, to prevent inadvertent disengagement therebetween said frame stand member and said base stand member.

* * * * *